US005899129A

United States Patent [19]

Sumida et al.

[11] Patent Number: 5,899,129

[45] **Date of Patent: *May 4, 1999**

[54] AUTOMATIC TRIMMING PROCESSING DEVICE

[75] Inventors: Kunihiro Sumida; Norihiro Kadota; Masashi Aoki, all of Kanagawa, Japan

[73] Assignee: Fuji Photo Film Co., Ltd., Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/620,249

[22] Filed: Mar. 22, 1996

[30] Foreign Application Priority Data

Mar. 23, 1995 [JP] Japan ..... 7-063776

[51] Int. Cl.[6] ..... B26D 5/02; B26D 7/18

[52] U.S. Cl. ..... 83/76.9; 83/100; 83/102; 83/156; 83/408; 83/425.4

[58] Field of Search ..... 83/100, 102, 105, 83/107, 76.1, 76.6, 76.9, 156, 408, 425.4, 151, 152

[56] References Cited

U.S. PATENT DOCUMENTS

| | | | |
|---|---|---|---|
| 2,242,887 | 5/1941 | Holdgate et al. | 83/408 |
| 2,500,772 | 3/1950 | Reed | 83/105 |
| 3,246,553 | 4/1966 | O'Brien | 83/408 X |
| 3,516,315 | 6/1970 | Suzuki | 83/408 |
| 3,795,164 | 3/1974 | Schneider | 83/100 X |
| 3,964,356 | 6/1976 | Dineen | 83/408 X |
| 4,242,934 | 1/1981 | Coburn | 83/100 |
| 4,467,975 | 8/1984 | Friedman | 242/564 |
| 4,549,452 | 10/1985 | Jobst | 83/100 |
| 4,611,518 | 9/1986 | Hildebrandt | 83/408 X |
| 4,704,930 | 11/1987 | Bodeweir | 83/100 X |
| 4,771,991 | 9/1988 | Sankaran | 83/105 X |
| 5,031,494 | 7/1991 | Asselborn et al. | 83/100 |
| 5,170,688 | 12/1992 | Keech et al. | 83/499 |
| 5,235,882 | 8/1993 | Rabourn | 83/408 X |
| 5,279,195 | 1/1994 | Breton | 83/102 X |
| 5,628,864 | 5/1997 | Kataigi et al. | 83/408 X |

FOREIGN PATENT DOCUMENTS

| | | |
|---|---|---|
| A1 0 692 370 | 7/1995 | European Pat. Off. . |
| 1484767 | 9/1977 | United Kingdom . |

*Primary Examiner*—Eugenia A. Jones
*Attorney, Agent, or Firm*—Sughrue, Mion, Zinn, Macpeak & Seas, PLLC

[57] ABSTRACT

A trimming processing device automatically processes trimmings generated when a running wide web is slit in the running direction of the web into a plurality of strips having desired widths. A trimming cutting unit movable in the transverse direction of the web cuts the trimmings in the transverse direction of the trimmings, and a trimming conveyor unit movable in the transverse direction of the web conveys the trimmings away from the web. The positions of the trimming cutting unit and the trimming conveyor unit are controlled according to the position of the trimmings which varies according to the width of the web and the width and the number of the strips to be slit from the web.

8 Claims, 13 Drawing Sheets

AUTOMATIC TRIMMING PROCESSING DEVICE

BACKGROUND OF THE INVENTION

1. Field of the Invention

This invention relates to an automatic trimming processing device for automatically processing trimmings generated in a slitter in which a wide web of flexible material such as film, paper, metal foil or the like is run and slit into a plurality of strips.

2. Description of the Related Art

In a slitter in which a wide web of flexible material such as film, paper, metal foil or the like is slit into a plurality of strips, preparatory steps of feeding out the wide web by setting the web to a delivery device, passing the wide web through pass rollers, conveyor rollers, a slitting section and a take-up section and setting slitting blades in the slitting section in predetermined positions according to the width of the wide web, the width of each strip and the number of strips to be obtained must be carried out before slitting. Such preparatory steps include the step of leading trimmings generated in the slitting section to a trimming processing apparatus through a predetermined path. This step will be referred to as "trimming passing work", hereinbelow.

Since the trimming passing work is often carried out also when the width of the web or the slitting width (the width of the strips) is changed, when the facilities are cleaned and when the facilities are repaired and since the trimming passing work must be done in a narrow space for a long time, the trimming passing work greatly increases load on the operator.

Especially, recently it is required to produce a large number of kinds of product in a small amount. Accordingly the frequency of change in size of the web or the strips and a long trimming passing work is required every time the size is changed, which results in deterioration in productivity of the slitter.

Further when the web is of photosensitive film or photosensitive paper, slitting must be carried out in a dark room. Accordingly the trimming passing work must be carried out lightening the room every time the size is changed. This also greatly deteriorates productivity of the slitter.

Thus there has been a demand for automating the trimming passing work. However though the step of changing the positions of the slitting blades according to the width of the wide web and the width of each strip slit from the wide web and the step of taking up the strips have been automated, the trimming passing work has not been automated because of difficulties in conforming to change in width and position of trimmings which change with the number and width of the strips to be slit from the wide web within profitable cost.

SUMMARY OF THE INVENTION

In view of the foregoing observations and description, the primary object of the present invention is to provide an automatic trimming processing device which can process trimmings automatically at low cost.

The trimming processing device in accordance with the present invention comprises

- a trimming cutting means which is movable in the transverse direction of the web and cuts the trimmings in the transverse direction of the trimmings,
- a trimming conveyor means which is movable in the transverse direction of the web and conveys the trimmings away from the web, and

- a control means which positions the trimming cutting means and the trimming conveyor means according to the position of the trimmings which varies according to the width of the web and the width and the number of the strips to be slit from the web.

The trimming conveyor means may comprise an air conveyor duct.

In one embodiment of the present invention the trimming conveyor means comprises a trimming conveyor roller disposed at the entrance of an air conveyor duct, a trimming hook which holds an end portion of the trimmings cut by the trimming cutting means and conveys the trimmings to the entrance of the air conveyor duct and a trimming nip roller which presses the trimmings against the trimming conveyor roller.

It is preferred that the trimming conveyor means be provided on a single movable table which is movable in the transverse direction of the web.

Since being provided with a control means which controls the position of the trimming cutting means and the trimming conveyor means according to the position of the trimmings which varies according to the width of the web, the slitting width and the number of the strips slit from the web, the trimming processing device of the present invention can be automatically conformed to various changes in the width of the web, the slitting width and the number of the strips.

Accordingly, load on the operator in the trimming passing work is greatly reduced and the time required for the trimming passing work is greatly shortened, whereby productivity is greatly increased and at the same time the labor for the slitter can be reduced.

Further when the trimming conveyor means comprising the trimming hook, the trimming nip roller, the air conveyor duct and the like is mounted on a single movable table, each component need not be provided with a mechanism for transversely moving the component, whereby an automatic trimming processing device which is simple in structure and can be manufactured at low cost can be realized.

DESCRIPTION OF THE PREFERRED EMBODIMENT

Figure 1:
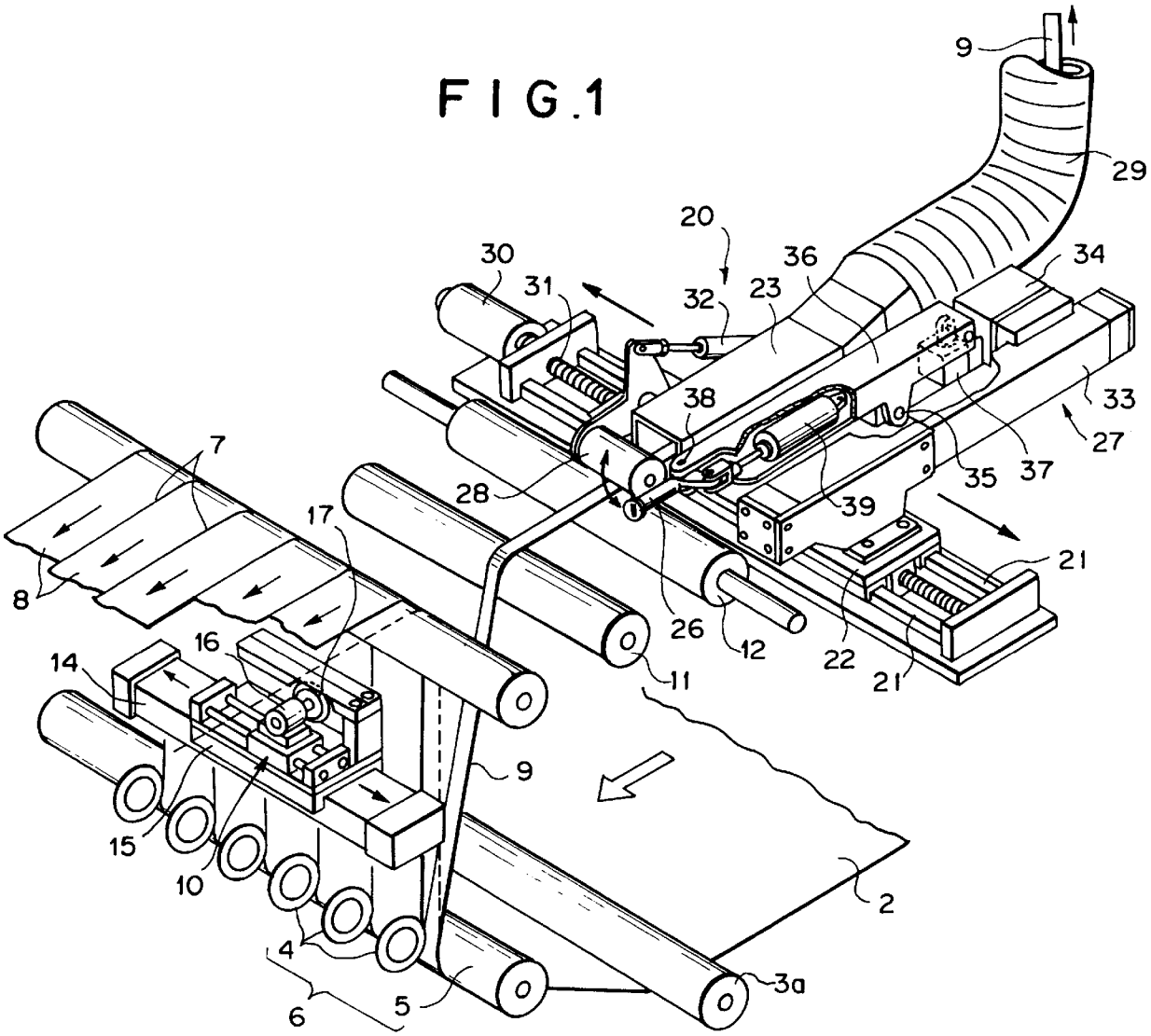
FIG. 1 is a perspective view showing a slitter provided with an automatic trimming processing device in accordance with an embodiment of the present invention.
Figure 2:
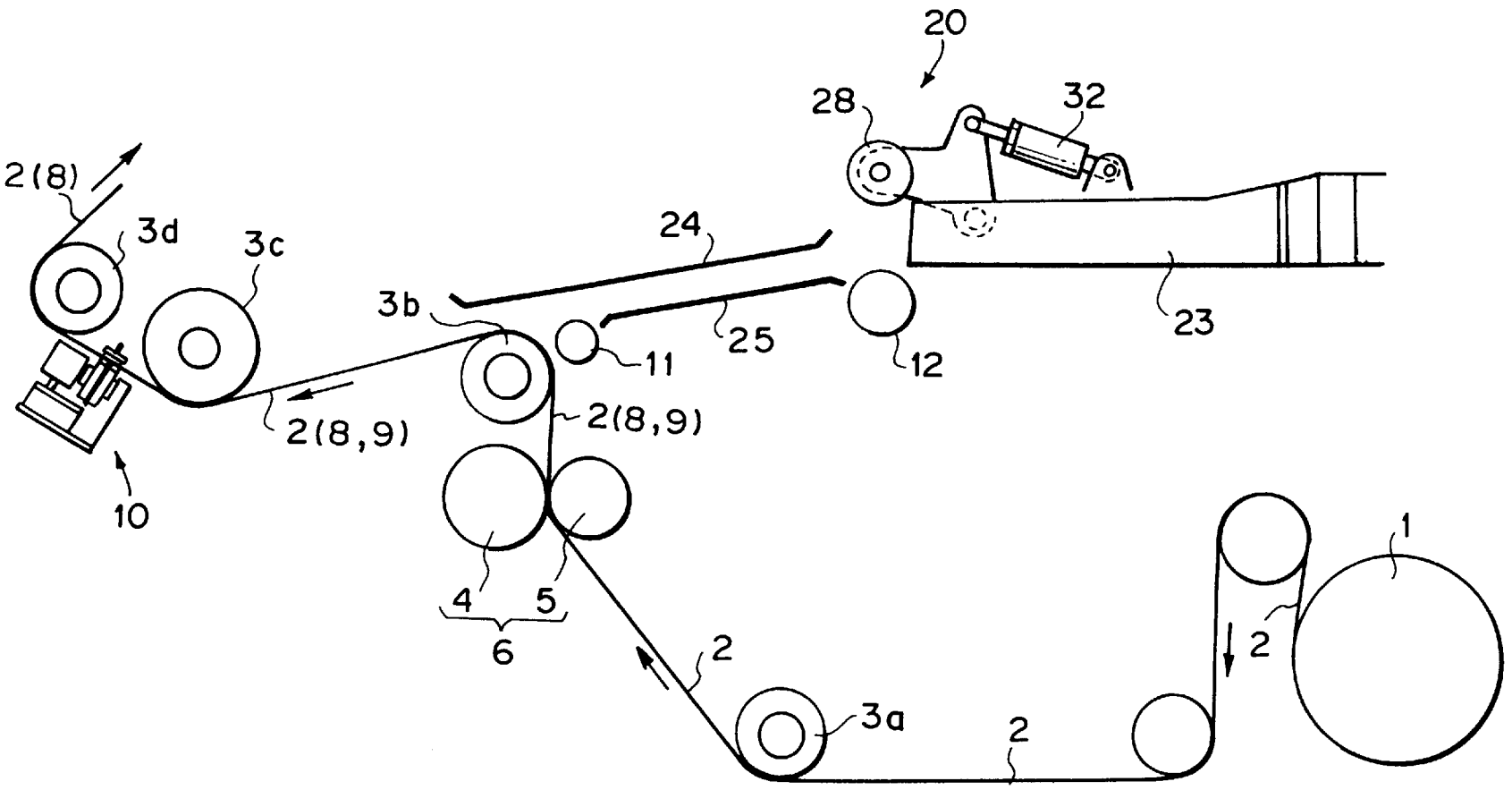
FIG. 2 is a schematic view showing the wide web conveying path and the layout of the trimming processing device in the slitter shown in FIG. 1.
Figure 3:
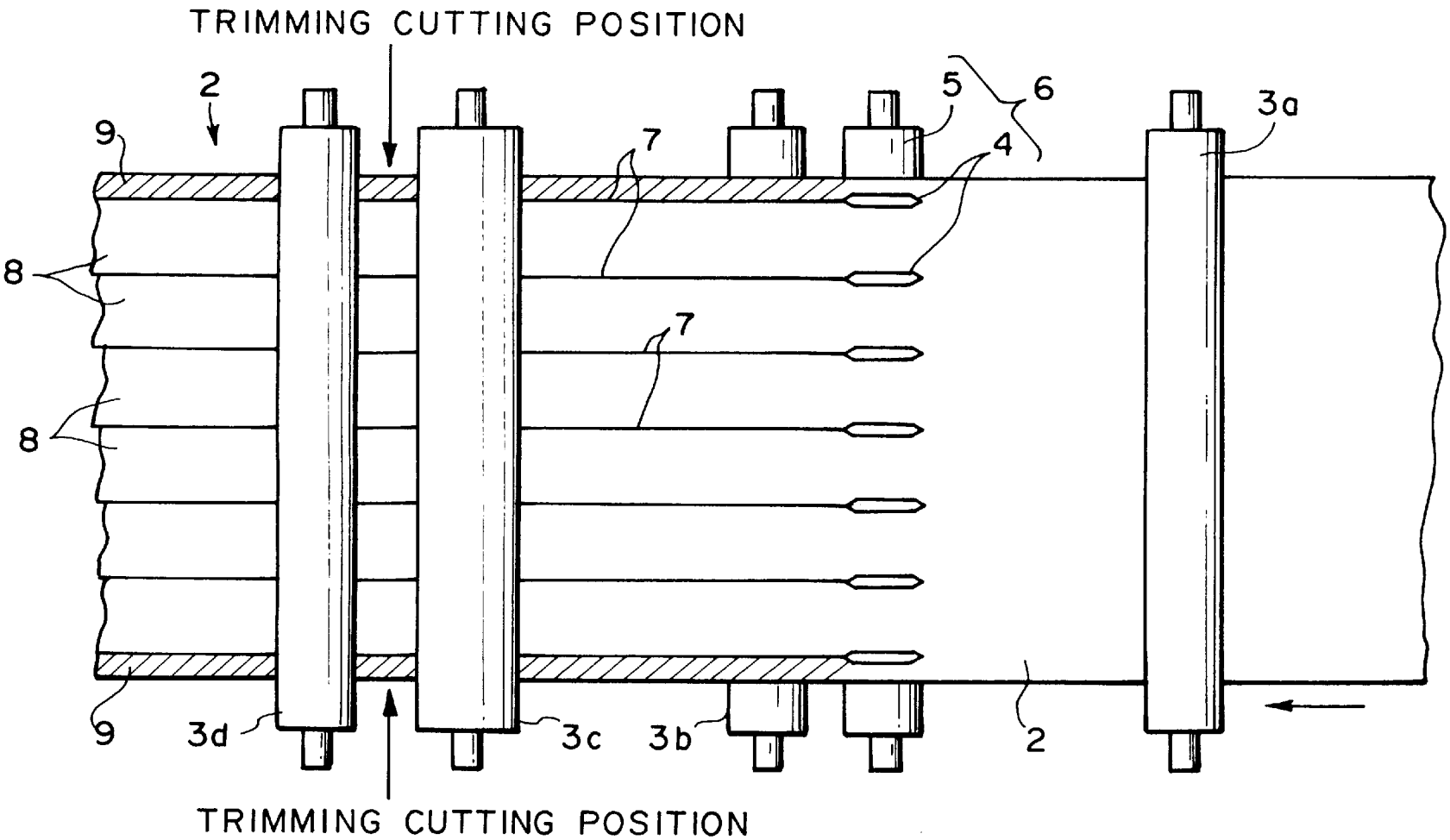
FIG. 3 is a development showing the wide web conveying path in the slitter shown in FIG. 1.

In FIGS. 1 to 5, a wide web 2 fed out from a web roll 1 supported by a delivery device runs to a slitting section 6 through a pass roller 3*a* and is slit into a plurality of strips 8 of a predetermined width by upper and lower slitting blades 4 and 5 of the slitting section 6. Reference numeral 7 denotes slit formed between the strips 8. The strips 8 are taken up by a take-up section (not shown) through pass rollers 3*b*, 3*c* and 3*d*. Opposite edges of the web 2 is slit into trimmings 9. A trimming cutting unit 10 (to be described later) for cutting the trimmings 9 transversely to the web 2 is disposed between the pass rollers 3*c* and 3*d*. In FIG. 1, the pass rollers 3*c* and 3*d* are omitted.

An automatic trimming processing device in accordance with an embodiment of the present invention comprises the trimming cutting unit 10 and a trimming conveying means which conveys the trimmings 9 away from the strips 8. The trimming conveying means comprises a trimming pass roller 11 disposed adjacent to the pass roller 3*b* in parallel thereto, a trimming conveyor roller 12 and a trimming conveyor unit 20. The widths of the trimming pass roller 11 and the trimming conveyor roller 12 are set larger than the possible largest width of the wide web 2 like the pass rollers 3*a* to 3*d*.

Figure 4:
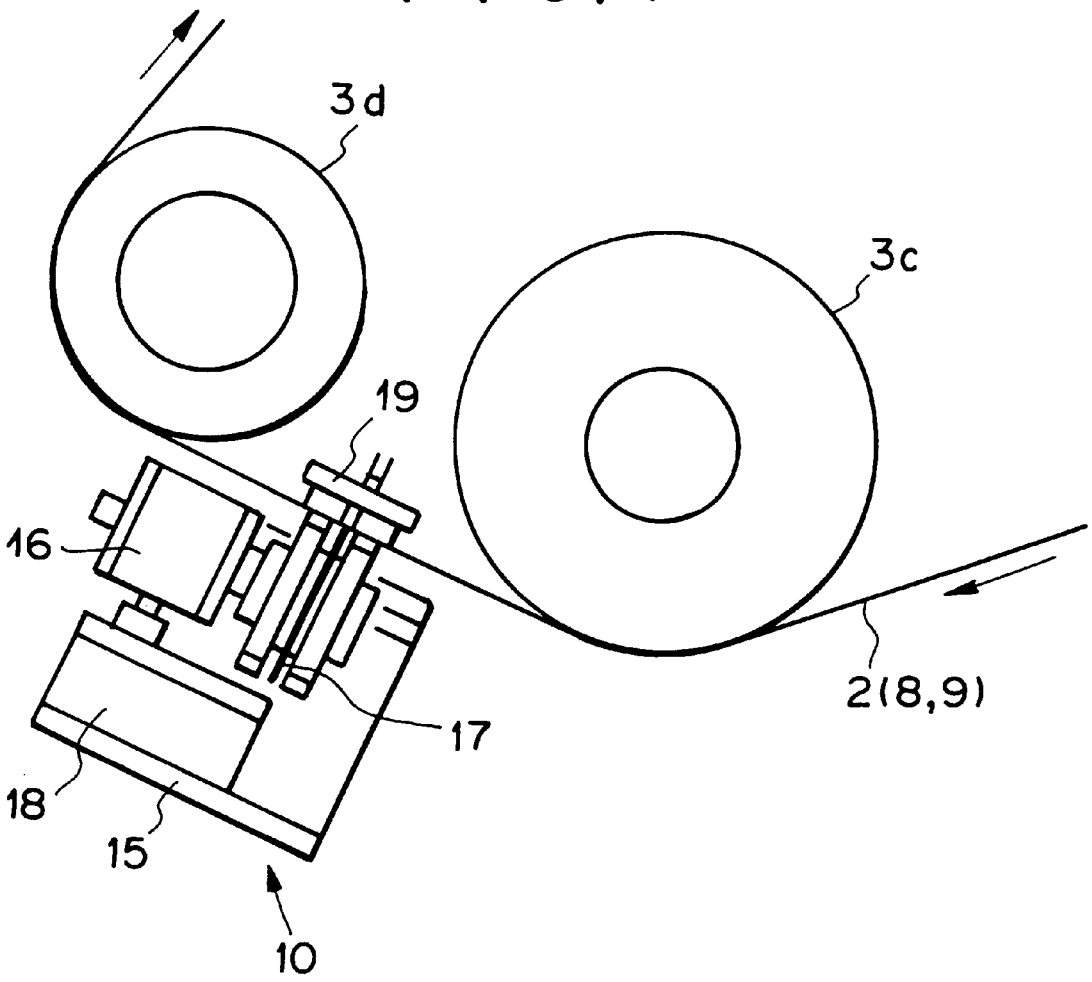
FIG. 4 is a front view showing the trimming cutting unit employed in the automatic trimming processing device of the embodiment.

As shown in FIG. 1, trimming cutting unit 10 is mounted on a movable table 15 which is movable in the transverse direction of the web 2 on a rail 14. The trimming cutting unit 10 comprises, as shown in more detail in FIG. 4, a rotary cutter 17 driven by a motor 16, a cylinder 18 which moves the rotary cutter 17 together with the motor 16 toward and away from the trimmings 9, and a backing blade 19 which is opposed to the rotary cutter 17 intervening therebetween the trimmings. The backing blade 19 is moved up and down away and toward the trimmings 9 by a cylinder (not shown). When the trimmings 9 are to be cut, the backing blade 19 is moved downward into contact with the trimmings 9 and otherwise it is held above the trimmings 9 away therefrom. In FIGS. 1 and 4, a motor mechanism for driving the movable table 15 are omitted.

The trimming conveyor unit 20 is provided on a movable table 22 which is slidably mounted on a guide rails 21 extending in the transverse direction of the web 2 and is movable in the transverse direction of the web 2. The trimming conveyor unit 20 comprises an air conveyor duct 23 for conveying the trimmings 9 to a trimming compactor (not shown) disposed downstream, upper and lower guide plates 24 and 25 which are disposed between the trimming pass roller 11 and the trimming conveyor roller 12 in parallel to each other and guide the trimmings 9 toward the entrance of the air conveyor duct 23, a trimming hook 26 which catches an end of the trimmings 9 cut by the trimming cutting unit 10 and conveys the trimmings 9 to the entrance of the air conveyor duct 23, a trimming hook drive mechanism 27, and a trimming nip roller 28 which presses the trimmings 9 against the trimming conveyor roller 12 and feeds the trimmings 9 into the air conveyor duct 23 associated with the conveyor roller 12. A flexible hose 29 is connected to the air conveyor duct 23 to permit lateral movements of the air conveyor duct 23. The upper guide plate 24 is smaller than the lower guide plate 25 in width and extends to above the pass roller 3*b* as shown in FIG. 5.

The movable table 22 is moved in the transverse direction of the web 2 driven by a motor 30 through a leadscrew 31 and the like. The trimming nip roller 28 is moved up and down by a cylinder 32. In FIG. 1, the guide plates 24 and 25 are omitted and in FIG. 2, the trimming hook 26 and the trimming hook drive mechanism 27 are omitted.

The structure of the trimming hook 26 and the trimming hook drive mechanism 27 and their operation will be described with reference to FIGS. 5 to 8 and FIGS. 9A to 9C, FIGS. 10A to 10C and FIGS. 11A and 11B, hereinbelow. Though the trimming processing device shown in FIG. 1 is for processing the trimmings 9 on the near side of the web 2, the trimming processing device shown in FIGS. 5 to 8 is for processing the trimmings 9 on the remote side of the web 2.

Figure 5:
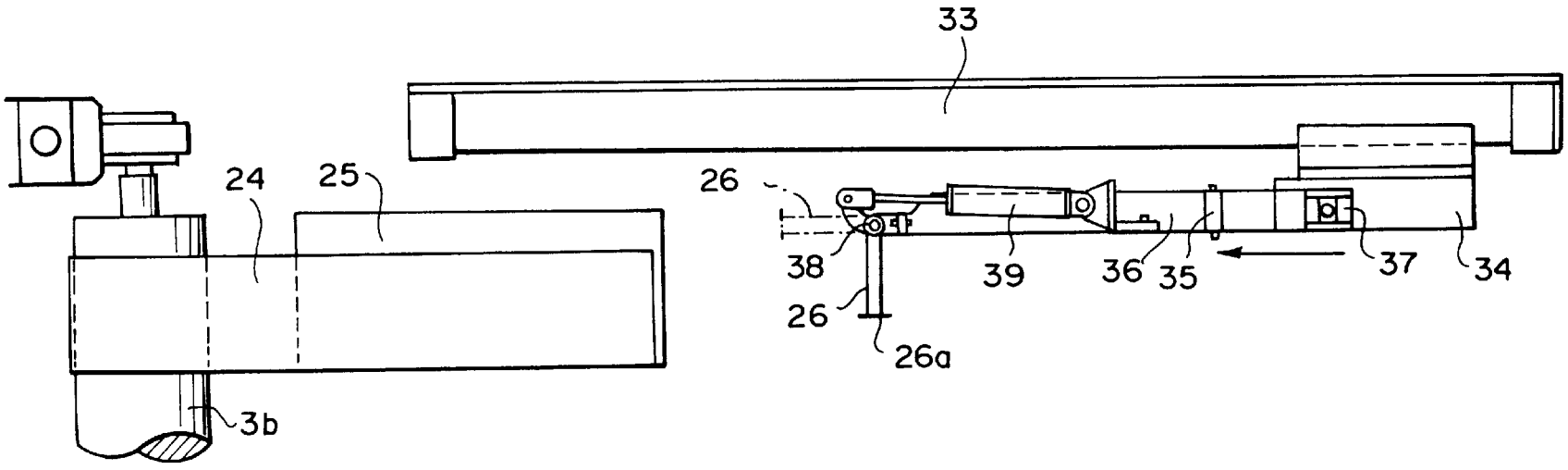
FIG. 5 is a plan view showing the trimming hook drive mechanism with the trimming hook in the retracted position employed in the automatic trimming processing device of the embodiment.
Figure 6:
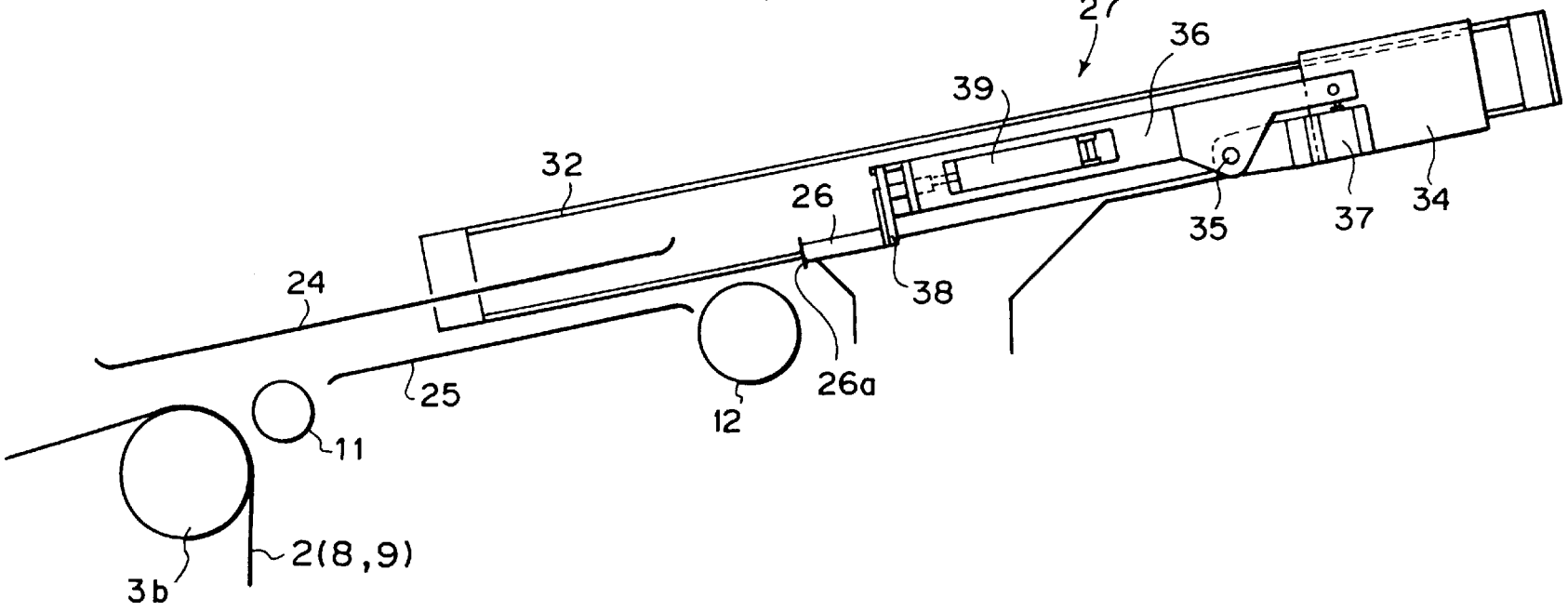
FIG. 6 is a side view of the trimming hook drive mechanism with the trimming hook in the retracted position.

FIGS. 5 and 6 are a plan view and a side view, respectively, showing the initial state in which the trimming hook 26 is waiting behind the trimming conveyor roller 12. The trimming hook drive mechanism 27 comprises a guide rail 33 fixed to the movable table 22 in parallel to the guide plates 24 and 25, a slider 34 which is slidable along the guide rail 33 and is moved by an air pressure between a retracted position shown in FIGS. 5 and 6 and an advanced position shown in FIGS. 7 and 8, a trimming hook support arm 36 which is rotatable up and down about a horizontal shaft 35 extending in perpendicular to the sliding direction of the slider 34, and a cylinder 37 for rotating up and down the trimming hook support arm 36.

The trimming hook 26 is in the form of a roller and is supported on a vertical shaft 38 provided on the front end of the arm 36 at one end thereof for rotation in a horizontal plane about the vertical shaft by 90°. The trimming hook 26 is rotated by a cylinder 39 provided on the arm 36. The trimming hook 26 is held in a position where a flange 26*a* on the free end thereof is directed forward as shown by the chained line in FIG. 5 and by the solid line in FIG. 6 until the trimming hook 26 is moved to below the trimmings 9 from the initial state. When the trimming hook 26 is to catch the trimmings 9, the trimming hook 26 is rotated to a position where the flange 26*a* is directed sideways as shown by the solid line in FIG. 5. The length of the trimming hook 26 as measured in the longitudinal direction thereof is slightly larger than the possible largest width of the trimmings 9.

Figure 9A:
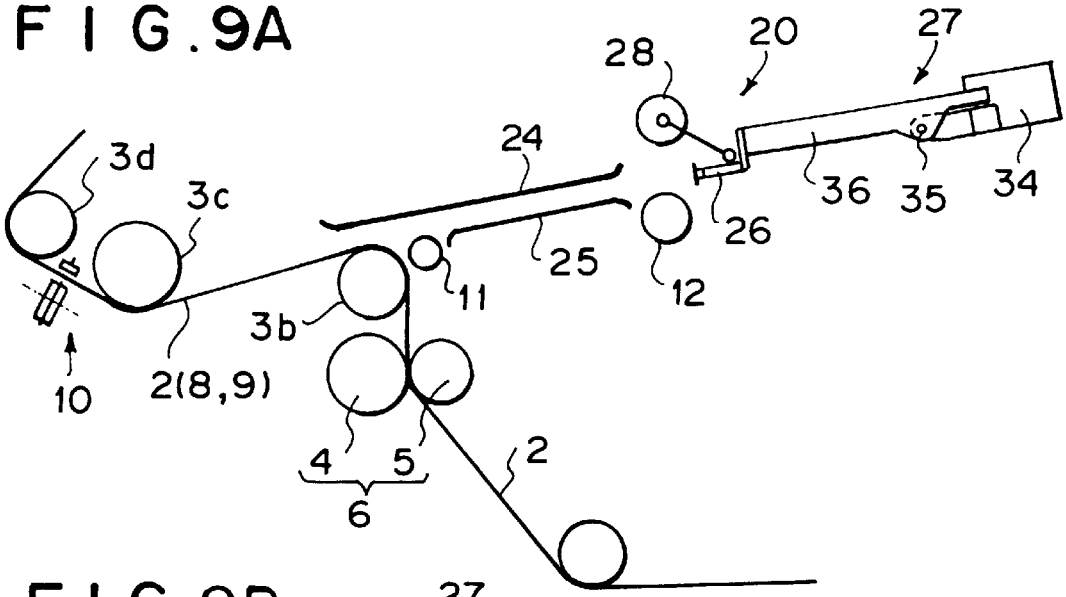
FIGS. 9A to 9C, 10A to 10C, 11A and 11B are views for illustrating the operation of the automatic trimming processing device.

FIG. 9A shows the initial state of the automatic trimming processing device where the trimming hook 26 is retracted to the entrance of the air conveyor duct 23 behind the trimming conveyor roller 12 and the trimming nip roller 28 is above the trimming conveyor roller 12 away therefrom. The rotary cutters 17 and the backing blade 19 of the trimming cutting unit 10 are away from the web 2.

Figure 7:
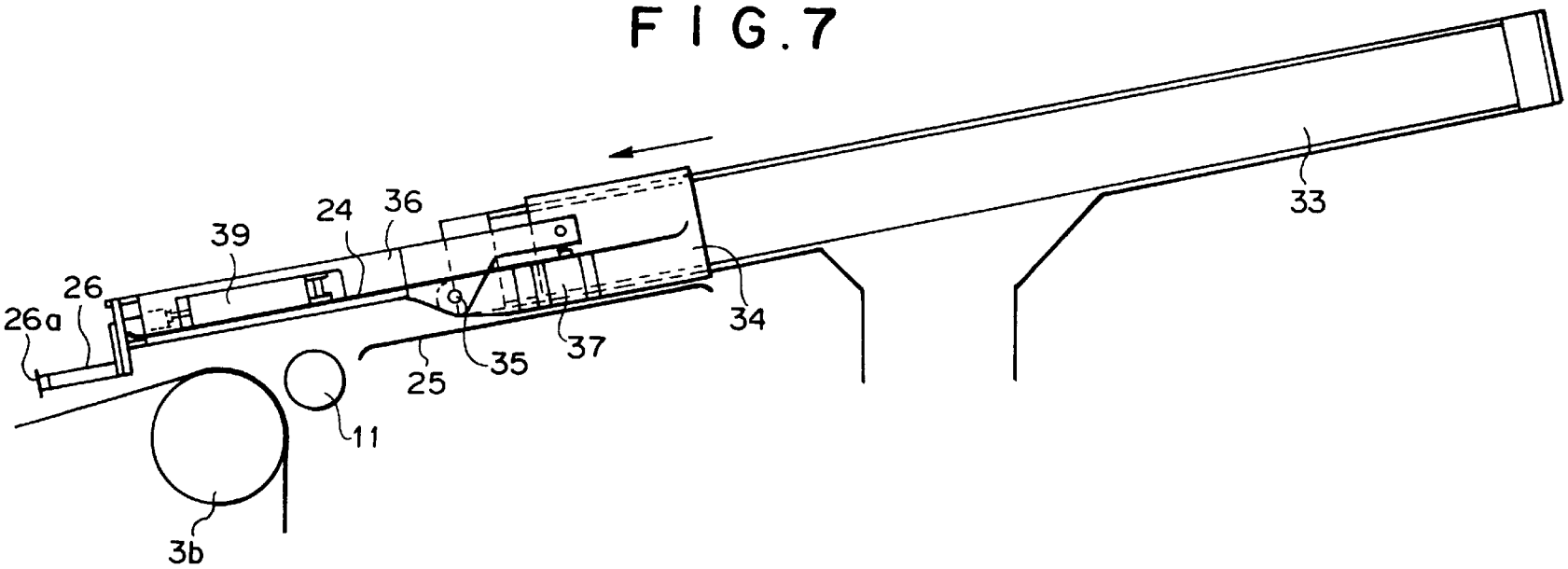
FIG. 7 is a side view of the trimming hook drive mechanism with the trimming hook in the advanced position.
Figure 9B:
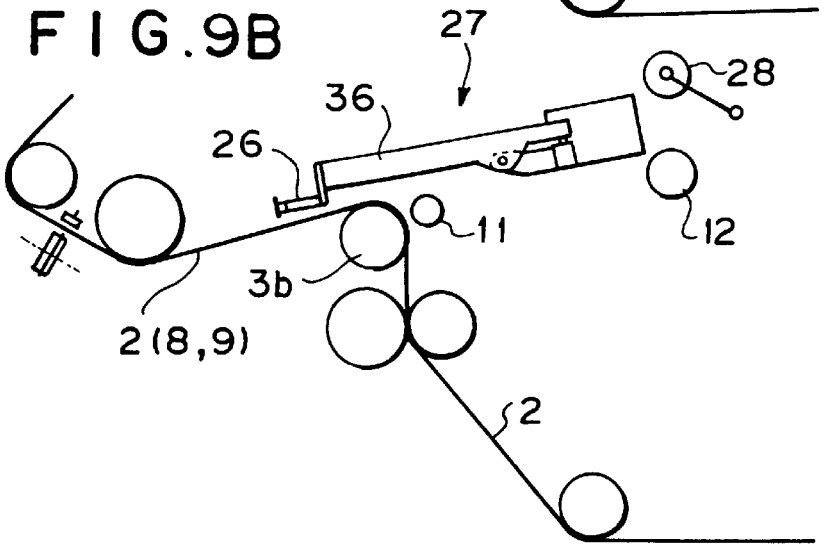

When the slider 34 is driven in this state, the slider 34 is moved to the advanced position shown in FIG. 7 and FIG. 9B, and the trimming hook 26 is moved above the lower guide plate 25 to a position in front of the pass roller 3*b* above the same with the flange 26*a* directed forward.

Figure 8:
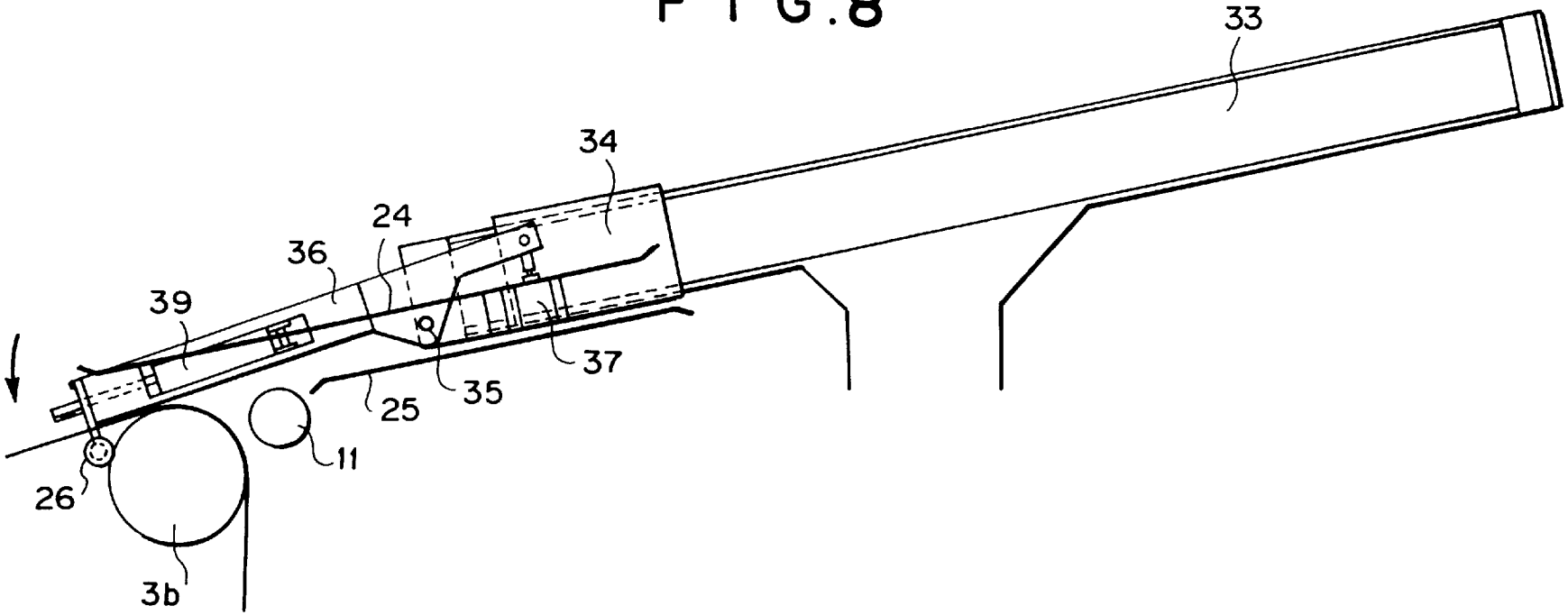
FIG. 8 is a side view of the trimming hook drive mechanism with the trimming hook in the lowered position.
Figure 9C:
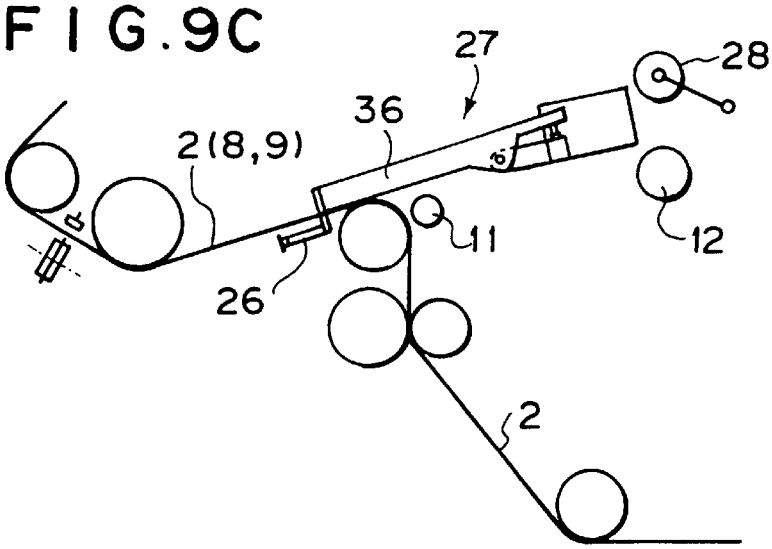
Figure 10A:
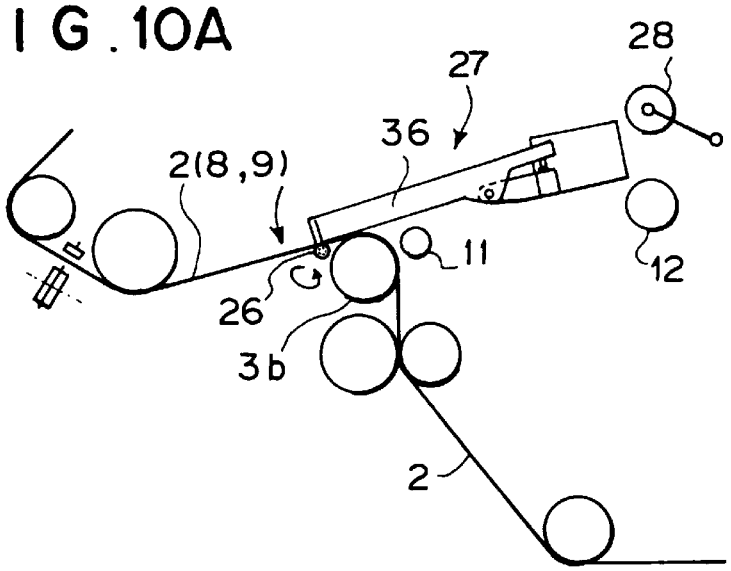

Then as shown in FIG. 9C, the arm 36 is counterclockwisely swung by the cylinder 37 to lower the trimming hook 26, whereby the trimming hook 26 is moved below the trimmings 9 on one side of the trimmings 9. Then the trimming hook 26 is rotated by 90° in a horizontal plane by the cylinder 39 so that the trimming hook 26 extends in the transverse direction of the web 2 just below the trimmings 9 as shown in FIG. 8 and FIG. 10A.

Figure 10B:
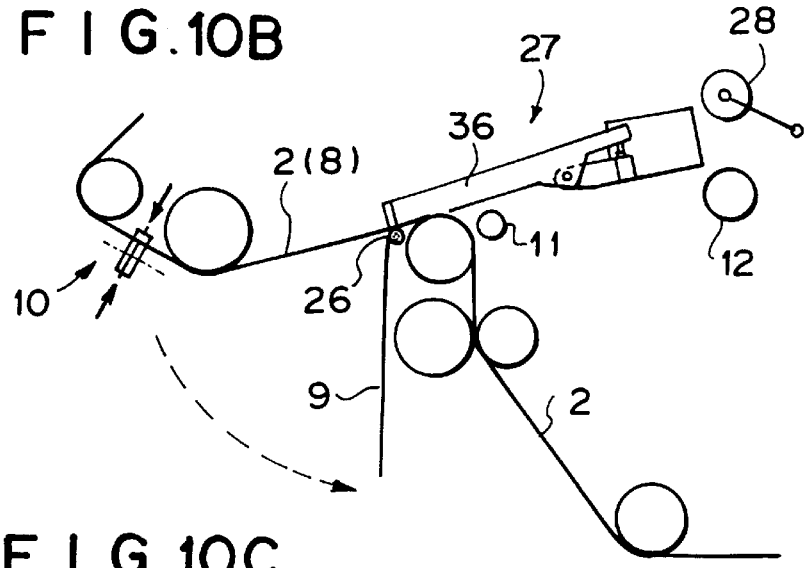
Figure 10C:
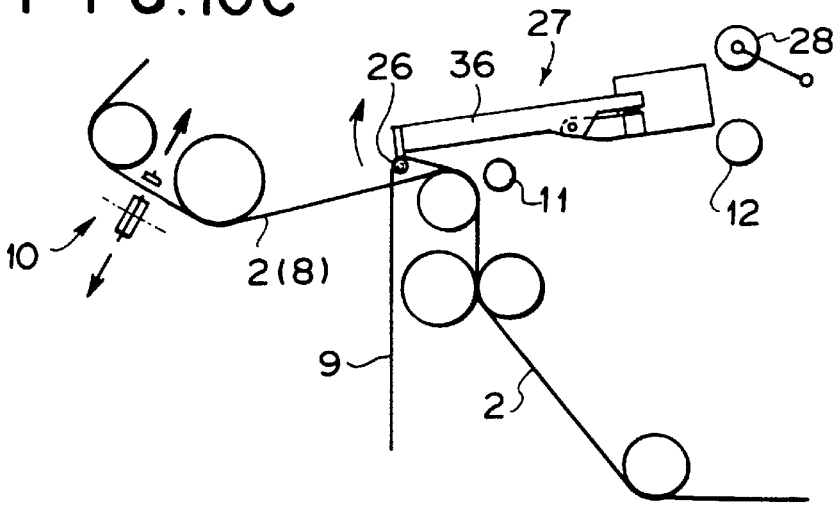

In this state, the rotary cutter 17 is moved toward the trimmings 9 and the backing blade 19 is moved downward, whereby the trimmings 9 are cut. As a result, the trimmings 9 are removed away from the web 2 and the trimmings 9 come to hang on the trimming hook 26 as shown in FIG. 10B. Then the arm 36 is clockwisely swung by the cylinder 37 and the trimming hook 26 is moved above the pass roller 3*b*, whereby the trimmings 9 is lifted above the web 2 as shown in FIG. 10C.

Figure 11A:
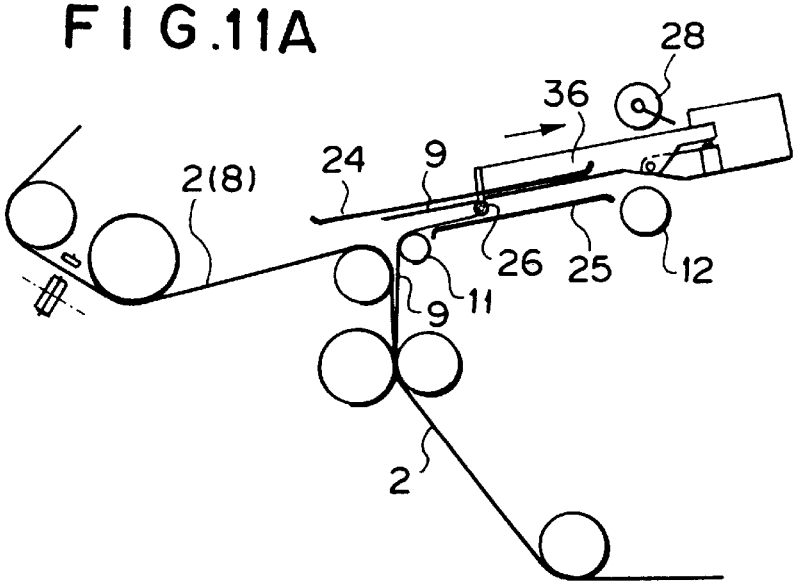
Figure 11B:
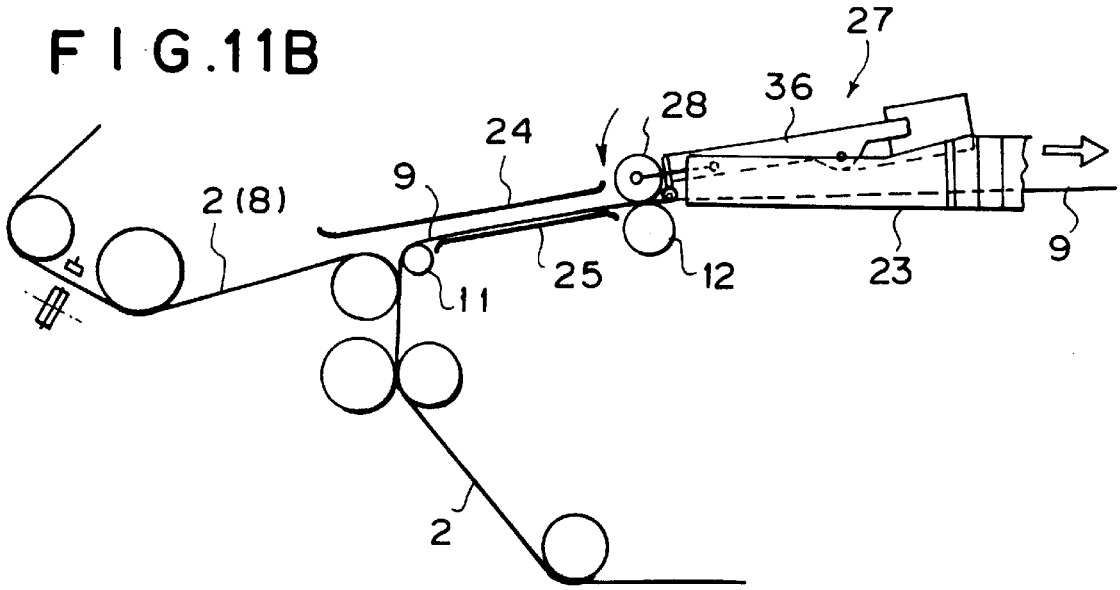

Then the slider 34 is moved to the retracted position and the trimming hook 26 is retracted to the entrance of the air conveyor duct 23 holding the trimming thereon as shown in FIG. 11A, whereby an end of the trimmings 9 passes above the trimming conveyor roller 12 and reaches the entrance of the air conveyor duct 23 under the guidance of the guide plates 24 and 25, and then is sucked into the air conveyor duct 23. At this time, the trimming nip roller 28 is moved downward onto the trimming conveyor roller 12 and presses the trimmings 9 against the trimming conveyor roller 12 as shown in FIG. 11B. Accordingly, from this time on, the trimmings 9 are conveyed to the air conveyor duct 23 by the trimming conveyor roller 12 and the trimming nip roller 28 and then conveyed to the trimming compactor by the air conveyor duct 23.

Figure 12:
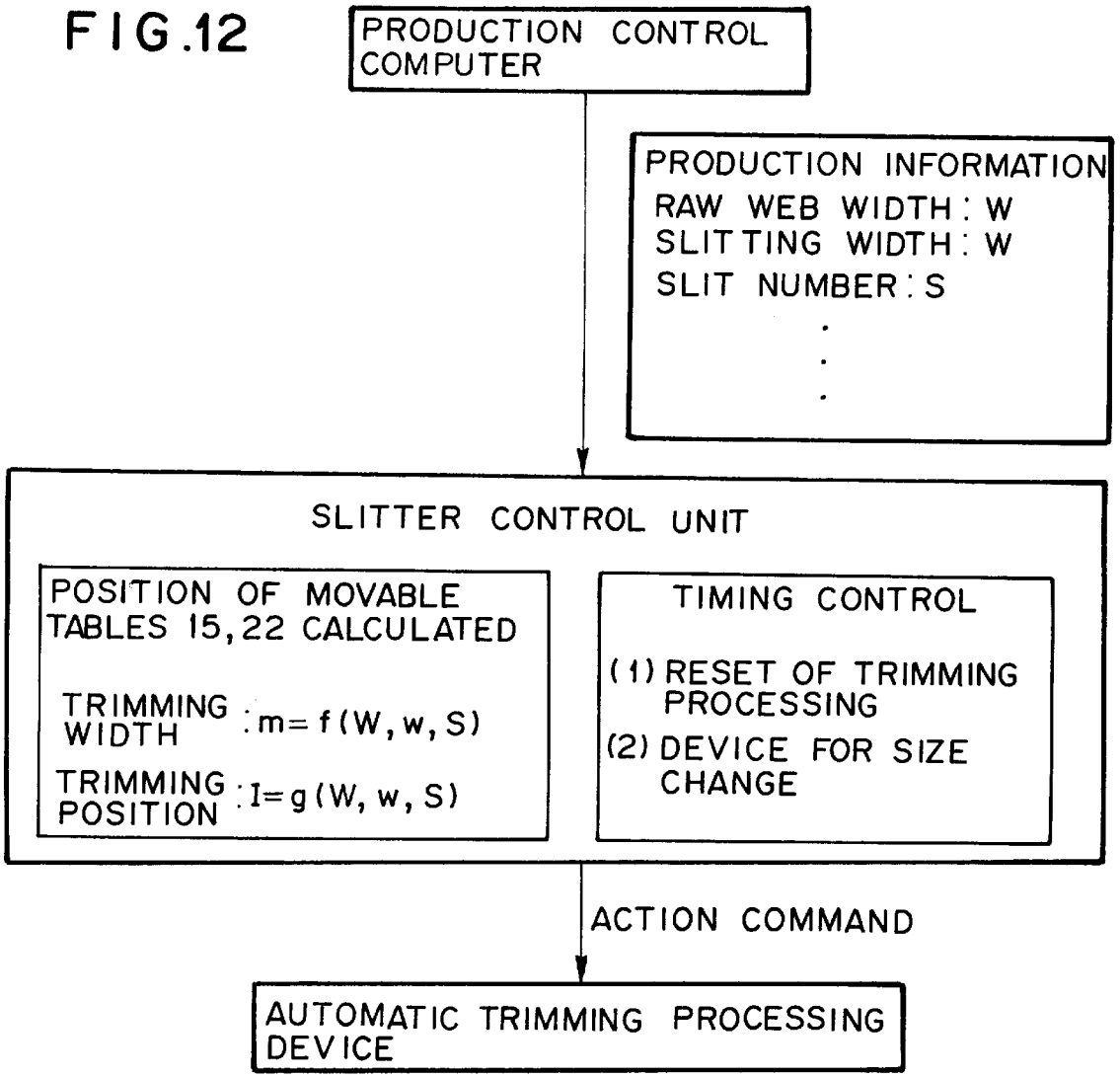
FIG. 12 is a flow chart for illustrating the control in the automatic trimming processing device.

The series of actions of the trimming processing device described above are carried out by a production control computer which controls the motor and the cylinder 18 for driving the movable table 15 of the trimming cutting unit 10, the motor 30 for driving the movable table 22 of the trimming hook drive mechanism 27, the air for driving the slider 34 and the cylinders 32, 37 and 39 by way of the slitter control unit as shown in FIG. 12.

As shown in FIG. 12, production information such as the width W of web, the slitting width (the width of each strip 8 slit from the web) w, the number S of the slits 7 and the like is input into the production control computer. When trimmings are to be generated on opposite sides of the web 2, the number of the strips 8 slit from the web 2 is smaller than the number S of the slits 7 by one.

Figure 13:
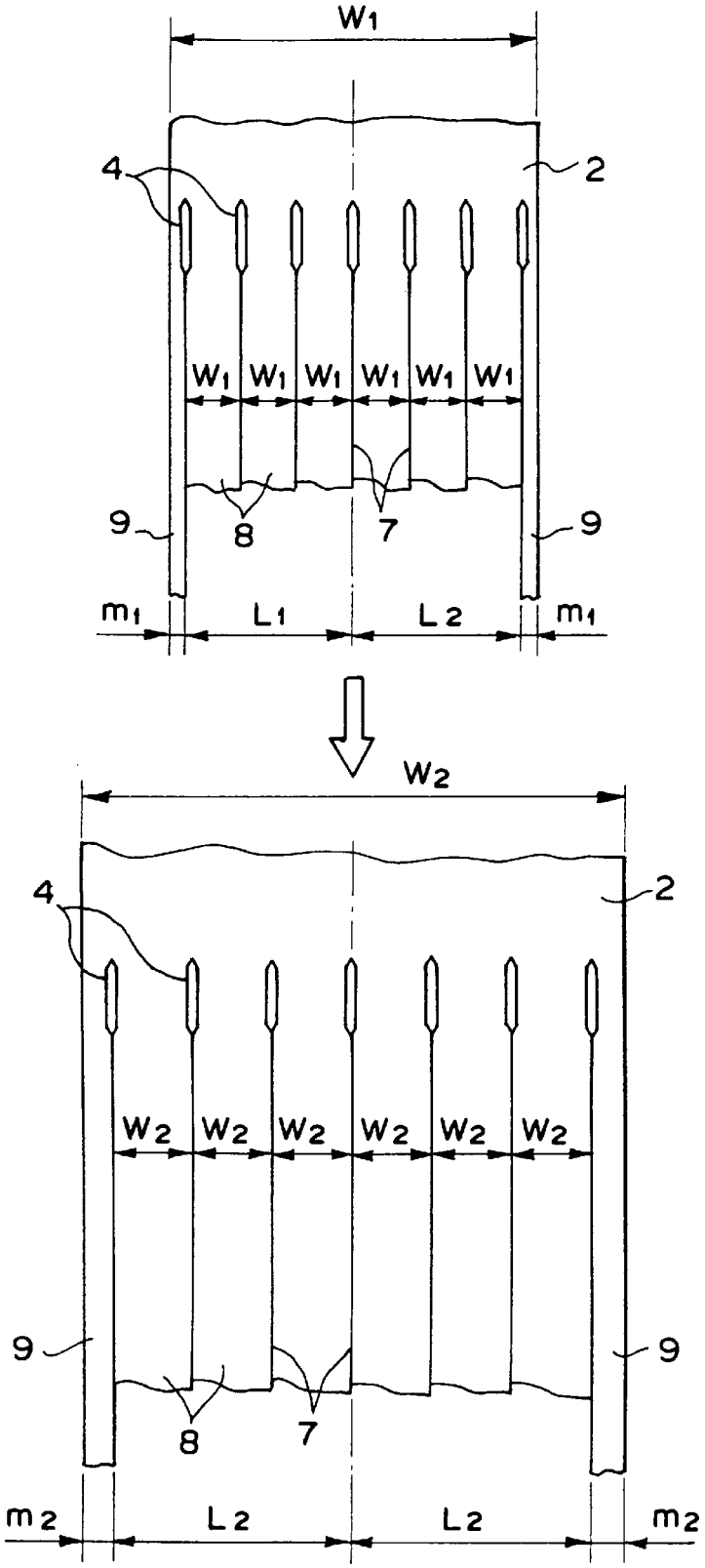
FIG. 13 is a view for illustrating the relation between the position of the trimmings and the width thereof upon size change.

The width m and the position of the trimmings 9 change with the width W of the web, the slitting width w and the number S of the slits 7 as can be understood from FIG. 13 which shows the relation between the width m and the position of the trimmings 9 upon size change. That is, the width m and the position of the trimmings 9 are functions of the width W of the web, the slitting width w and the number S of the slits 7. Accordingly, the trimming cutting unit 10 and the trimming conveyor unit 20 are moved in the transverse direction of the web 2 according to the width W of the web, the slitting width w and the number S of the slits 7, whereby the trimmings 9 are automatically processed.

As can be understood from the description above, since the trimming processing device of this embodiment is provided with a control means which controls the position of the trimming cutting unit 10 and the trimming conveyor unit 20 according to the position of the trimmings 9 which varies according to the width W of the web, the slitting width w and the number S of the slits, the trimming processing device can be automatically conformed to various changes in the width W of the web, the slitting width w and the number S of the slits.

Further in this particular embodiment, since the trimming hook drive mechanism 27, the guide plates 24 and 25, the trimming nip roller 28 and the air conveyor duct 23 are united into the trimming conveyor unit 20 mounted on a single movable table 22, each component need not be provided with a mechanism for transversely moving the component, whereby an automatic trimming processing device which is simple in structure and can be manufactured at low cost can be realized.

Though the embodiment described above is for processing the trimmings 9 generated on one edge of the web, the trimming processing device of the present invention may be arranged to process trimmings generated on opposite edges of the web at one time.

Further though in the embodiment described above, the trimmings 9 are conveyed to the entrance of the air conveyor duct 23 held by the trimming hook 26, the trimmings 9 may be conveyed to the entrance of the duct 23 by a nip member instead of the trimming hook 26. Further, the entrance of the air conveyor duct 23 may be disposed beside the trimming cutting unit 10 to directly suck the cut trimmings 9 into the air conveyor duct 23.

Further instead of inserting the trimming hook 26 under the trimmings 9 by lowering and rotating the trimming hook 26, the web 2 may be moved relative to the trimming hook 26. Further the trimming hook drive mechanism 27, the guide plates 24 and 25, the trimming nip roller 28 and the air conveyor duct 23 and the like may be transversely moved separately from each other. Further the air conveyor duct may be a fixed one having a wide entrance.

What is claimed is:

1. A trimming processing device for slitting a running wide web and automatically processing excess trimmings generated when the running wide web is slit in a running direction of the web into a plurality of strips having desired widths, said device comprising:

means for slitting the web into said plurality of strips; means for cutting the trimmings which is movable in a transverse direction of the web and cuts only the trimmings in the transverse direction of the trimmings to create a leading end for a trimming strip;

means for conveying the trimmings which is movable in the transverse direction of the web and continuously conveys the leading end of the trimming strip, as one piece, away from the web after the trimming strip has been initially cut by said trimming cutting means; and means for controlling said trimming cutting means and said trimming conveying means, which positions said trimming cutting means and said trimming conveying means according to the position of the trimmings which varies according to the width of the web and the width and the number of the strips to be slit from the web;

said trimming conveying means including grasping means for grasping the leading end of the trimming strip and means for causing said grasping means to move closer to said trimming cutting means before the leading end of the trimming strip is cut so that the trimming strip is conveyed from the web after the leading end of the trimming strip has been cut.

2. A trimming processing device as defined in claim 1 in which said trimming conveying means comprise an air conveyor duct.

3. A trimming processing device as defined in claim 2 in which said trimming conveying means further comprises a trimming conveyor roller disposed at an entrance of the air conveyor duct and a trimming nip roller which presses the trimmings against the trimming conveyor roller, and the grasping means includes a trimming hook which holds an end portion of the trimmings cut by said trimming cutting means and conveys the trimmings to the entrance of the air conveyor duct.

4. A trimming processing device as defined in claim 3 in which said trimming conveying means except for said conveyor roller is provided on a single movable table which is movable in the transverse direction of the web.

5. A trimming processing device for slitting a continuous web and automatically processing excess edges generated after the continuous web is slit longitudinally into a plurality of strips, said device comprising:

means for creating said plurality of strips;

means for cutting an excess edge from the web in a transverse direction while the excess edge abuts said plurality of strips to create a leading end on the excess edge, wherein said cutting means is adjustable in a lateral direction of the web;

means for conveying the excess edge, having a grasping means for grasping the leading end of the excess edge and for moving the leading end of the excess edge away from said cutting means and for continuously conveying the excess edge away from the web so that the excess edge does not abut said strips, wherein said conveying means is adjustable in the lateral direction of the web and said grasping means moves toward said cutting means before the leading end is created and moves away from said cutting means after the leading end is grasped; and a control means for controlling a movement of said cutting means and said conveying means, relative to the web and the excess edge.

6. A device for generating a plurality of strips of equal width from a continuous web, wherein said device generates an excess edge along a longitudinal end of the continuous web, said device comprising:

means for conveying a web along a web conveying direction;

means for slitting said continuous web in a longitudinal direction to create said plurality of strips of equal width as said web is conveyed in said web conveying direction by said web conveying means so as to create said excess edge;

an excess edge cutter arranged after said web slitting means in said web conveying direction for cutting said excess edge after said web slitting means creates said plurality of strips so as to create a leading end of said excess edge;

an excess edge conveyer for conveying said excess edge away from said plurality of strips on said web conveying means, wherein said excess edge conveyer conveys said excess edge after said leading end of said excess edge is created by said excess edge cutter so that said excess edge is conveyed in an excess edge conveying direction; and means for controlling said excess edge cutter and said excess edge conveyer so as to be positioned according to a width of said continuous web.

7. A device for generating a plurality of strips of equal width from a continuous web, wherein said device generates an excess edge along a longitudinal end of the continuous web, said device comprising:

means for conveying a web along a web conveying direction;

means for slitting said continuous web in a longitudinal direction to create said plurality of strips as said web is conveyed in said web conveying direction by said web conveying means so as to create said excess edge;

an excess edge cutter arranged after said web slitting means in said web conveying direction for cutting said excess edge after said web slitting means creates said plurality of strips so as to create a leading end of said excess edge;

an excess edge conveyer for conveying said excess edge away from said plurality of strips on said web conveying means, wherein said excess edge conveyer conveys said excess edge after said leading end of said excess edge is created by said excess edge cutter, so that said excess edge is conveyed in an excess edge conveying direction; and means for controlling said excess edge cutter and said excess edge conveyer so as to be positioned according to a width of said continuous web;

wherein said excess edge conveyer comprises a grasping means for grasping said leading end of said excess edge after said excess edge has been cut by said excess edge cutter.

8. A device for generating a plurality of strips of equal width from a continuous web, wherein said device generates an excess edge along a longitudinal end of the continuous web, said device comprising:

means for conveying a web along a web conveying direction;

means for slitting said continuous web in a longitudinal direction to create said plurality of strips as said web is conveyed in said web conveying direction by said web conveying means so as to create said excess edge;

an excess edge cutter arranged after said web slitting means in said web conveying direction for cutting said excess edge after said web slitting means creates said plurality of strips so as to create a leading end of said excess edge;

an excess edge conveyer for conveying said excess edge away from said plurality of strips on said web conveying means, wherein said excess edge conveyer conveys said excess edge after said leading end of said excess edge is created by said excess edge cutter, so that said excess edge is conveyed in an excess edge conveying direction; and means for controlling said excess edge cutter and said excess edge conveyer so as to be positioned according to a width of said continuous web;

wherein said conveying means conveys said plurality of strips and said excess edge in parallel until said excess edge is cut and said excess edge conveyer comprises a roller for conveying said excess edge away from said plurality of strips.

* * * * *